US009194572B2

(12) United States Patent
Chen et al.

(10) Patent No.: US 9,194,572 B2
(45) Date of Patent: Nov. 24, 2015

(54) LED LIGHTING DEVICE INCLUDING HEAT DISSIPATION STRUCTURE AND METHOD FOR MAKING THE SAME

(71) Applicant: SENGLED OPTOELECTRONICS CO., LTD, Tongxiang (CN)

(72) Inventors: Fang Chen, Tongxiang (CN); Jinxiang Shen, Tongxiang (CN)

(73) Assignee: SENGLED OPTOELECTRONICS CO., LTD, Tongxiang (CN)

( * ) Notice: Subject to any disclaimer, the term of this patent is extended or adjusted under 35 U.S.C. 154(b) by 89 days.

(21) Appl. No.: 14/275,011

(22) Filed: May 12, 2014

(65) Prior Publication Data

US 2014/0247606 A1 Sep. 4, 2014

Related U.S. Application Data

(63) Continuation-in-part of application No. PCT/CN2012/073361, filed on Mar. 31, 2012.

(30) Foreign Application Priority Data

Nov. 25, 2011 (CN) ..... 2011 1 0380199

(51) Int. Cl.

| | |
|---|---|
| ***F21V 29/00*** | (2015.01) |
| ***F21K 99/00*** | (2010.01) |
| ***F21V 29/83*** | (2015.01) |
| ***F21V 23/00*** | (2015.01) |
| ***F21V 29/506*** | (2015.01) |
| *F21Y 101/02* | (2006.01) |
| *F21Y 111/00* | (2006.01) |
| *F21V 29/77* | (2015.01) |

(52) U.S. Cl.

CPC ..... *F21V 29/004* (2013.01); *F21K 9/00* (2013.01); *F21K 9/90* (2013.01); *F21V 23/009* (2013.01); *F21V 29/506* (2015.01); *F21V 29/83* (2015.01); *F21K 9/13* (2013.01); *F21V 29/773* (2015.01); *F21Y 2101/02* (2013.01); *F21Y 2111/001* (2013.01); *Y10T 29/4913* (2015.01)

(58) Field of Classification Search

CPC ..... F21K 9/00; F21K 9/13; F21K 9/90; F21V 23/009; F21V 29/004; F21V 29/83; F21V 29/506; F21V 29/773; F21Y 2101/02; F21Y 2111/001; Y10T 29/4913

See application file for complete search history.

(56) References Cited

U.S. PATENT DOCUMENTS

| | | | | |
|---|---|---|---|---|
| 8,066,414 | B2 * | 11/2011 | Pabst | F21K 9/135 362/249.02 |
| 2005/0111234 | A1 * | 5/2005 | Martin | F21K 9/137 362/555 |
| 2012/0013251 | A1 * | 1/2012 | Chang | F21K 9/135 315/35 |
| 2012/0098429 | A1 * | 4/2012 | Liang | F21K 9/1355 315/70 |

* cited by examiner

*Primary Examiner* — Stephen F Husar
(74) *Attorney, Agent, or Firm* — Anova Law Group, PLLC

(57) ABSTRACT

LED lighting devices and fabrication methods are provided. An LED lighting device includes a heat dissipation lamp cup including a hollow structure, a driving power supply casing socket configured within the heat dissipation lamp cup to form a ventilation gap between the driving power source casing and an inner wall of the heat dissipation lamp cup, and a lamp holder configured on top of the heat dissipation lamp cup. The lamp holder includes one or more sidewalls forming a ventilation channel passing through the lamp holder. The ventilation channel is connected to the ventilation gap for air circulation. The LED lighting device also includes a substrate configured on an outer surface of each of the one or more sidewalls of the lamp holder and a plurality of LED light sources mounted on the substrate.

20 Claims, 4 Drawing Sheets

LED LIGHTING DEVICE INCLUDING HEAT DISSIPATION STRUCTURE AND METHOD FOR MAKING THE SAME

CROSS-REFERENCES TO RELATED APPLICATIONS

This application is a continuation in part of PCT application No. PCT/CN2012/073361, filed on Mar. 31, 2012, which claims the priority of Chinese Patent Application No. 201110380199.1, filed on Nov. 25, 2011, the entire contents of all of which are incorporated herein by reference.

FIELD OF THE DISCLOSURE

The present disclosure relates to the field of light emitting diode (LED) technology and, more particularly, relates to an LED lighting device including a heat dissipation structure and fabrication method of the LED lighting device.

BACKGROUND

Cooling of an LED lighting device is important for stable operations and high quality of LED lighting devices. Conventionally, cooling of the LED lighting devices mainly focus on cooling of LED light sources, for example, by improving the shape, structure, and material quality of a heat dissipation lamp cup to optimize the cooling performance. Often, the cooling of the driving power supply of the LED lighting device is not considered.

Conventional high-power LED lighting devices may use a hollow heat dissipation lamp cup configured with a lamp holder to fix LED lightening components thereon. Driving power supply casing may be configured within the heat dissipation lamp cup. The upper and lower end of the driving power supply casing may be closed, while the wall of the driving power supply casing may be configured against the wall of the driving power supply accommodating chamber. When the device is in operation, heat generated by the LED light sources may be transmitted through the lamp holder to the heat dissipation lamp cup to dissipate. However, the heat dissipation lamp cup may have already held heat generated due to the operation of the device. It may then be difficult to effectively dissipate heat from the LED lighting device. The driving circuit board inside the heat dissipation lamp cup may be always surrounded by a high-temperature environment. Consequently, overtime, electronic components of the driving power supply may not work properly, which may affect the lifespan of the LED lighting device.

BRIEF SUMMARY OF THE DISCLOSURE

One aspect or embodiment of the present disclosure includes an LED lighting device. The LED lighting device includes a heat dissipation lamp cup including a hollow structure, a driving power supply casing socket joint within the heat dissipation lamp cup to form a ventilation gap between the driving power source casing and an inner wall of the heat dissipation lamp cup, and a lamp holder configured on top of the heat dissipation lamp cup. The lamp holder includes one or more sidewalls forming a ventilation channel passing through the lamp holder. The ventilation channel is connected to the ventilation gap for air circulation. The LED lighting device also includes a substrate configured on an outer surface of each of the one or more sidewalls of the lamp holder and a plurality of LED light sources mounted on the substrate.

Another aspect or embodiment of the present disclosure includes a method for making an LED lighting device by providing a heat dissipation lamp cup including a hollow structure. A driving power supply casing is socket-configured within the heat dissipation lamp cup to provide a ventilation gap between the driving power source casing and an inner wall of the heat dissipation lamp cup. A lamp holder is configured on top of the heat dissipation lamp cup. The lamp holder includes one or more sidewalls forming a ventilation channel passing through the lamp holder. The ventilation channel is connected to the ventilation gap for an air circulation. A substrate is configured on an outer surface of each of the one or more sidewalls of the lamp holder. A plurality of LED light sources is configured on the substrate.

A bulb-shaped shell is configured on the heat dissipation lamp cup to enclose the lamp holder and the plurality of LED light sources within the bulb-shaped shell. The bulb-shaped shell includes a cover configured with a plurality of ventilation holes for the air circulation.

A plurality of outer cooling plates is longitudinally configured and circumferentially distributed along an outer periphery of the heat dissipation lamp cup to facilitate heat dissipation. The lamp holder includes an outer contour providing a 3-dimensional shape including a polyhedron, a cylinder, or a frustum. The lamp holder is configured such that an entire light emitting angle of the plurality of LED sources is about 300 degree or greater.

A plurality of inner cooling plates is longitudinally configured and distributed within the ventilation channel of the lamp holder. A receiving ring is configured on an outer periphery of a lower portion of the driving power source casing and configured against a lower portion of the heat dissipation lamp cup. The receiving ring supports the heat dissipation lamp cup and includes a plurality of holes connected to the ventilation gap for the air circulation with ambient air.

At least two convex ribs are longitudinally configured along a length of the driving power source casing to lock a position of the driving power source casing with respect to the inner wall of the heat dissipation lamp cup. The at least two convex ribs are configured such that a fixed distance for the ventilation gap is maintained between an outer wall of the driving power source casing and the inner wall of the heat dissipation lamp cup.

Other aspects or embodiments of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Figure 1:
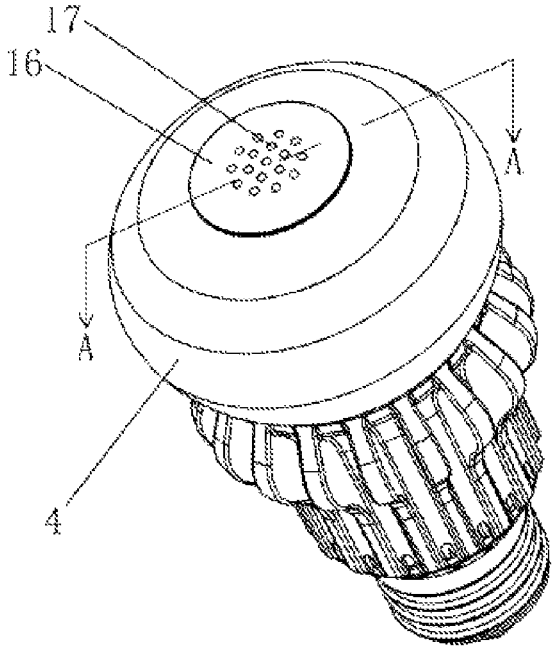
FIG. 1 is a schematic illustrating a perspective view an exemplary LED lighting device consistent with various disclosed embodiments.

Reference will now be made in detail to exemplary embodiments of the disclosure, which are illustrated in the accompanying drawings. Wherever possible, the same reference numbers will be used throughout the drawings to refer to the same or like parts.

Disclosed herein provides an LED lighting device including a heat dissipation structure that provides an internal cooling passage and an external cooling passage. The internal cooling passage can internally vent away at least a portion of the heat generated by a driving power supply and LED light source(s). The external cooling passage can include heat dissipation of at least a portion of the heat generated by the LED light sources through a heat dissipation lamp cup to the ambient environment by nature convection.

In this manner, the temperature of the heat dissipation lamp cup can be effectively reduced and would not burn human's hands when touched. In addition, the driving power supply can be cooled in embodiments consistent with the present disclosure. In the present disclosure, the effect of the heat dissipation lamp cup on the temperature of the driving power supply can be the reduced. Further, embodiments consistent with the present disclosure lower the environment temperature of the driving power supply to extend the lifespan of the power supply.

In one embodiment, the LED lighting device can include a lamp head, a heat dissipation lamp cup, a driving power source casing, and/or a bulb-shaped shell. The heat dissipation lamp cup, which is a heat sink, can have an inner hollow structure. The heat dissipation lamp cup can be socket configured together with the driving power supply casing. The driving power source casing and an inner wall of the heat dissipation lamp cup can be configured to have a ventilation gap formed there-between.

A lamp holder can be configured to protrude from the top of the heat dissipation lamp cup. A lamp holder can have sidewalls each configured with a substrate, wherein LED light sources can be fixed thereon. The lamp holder can include ventilation channel passing through the entire lamp holder.

The bulb-shaped shell can have a cover configured with ventilation holes. The top of the ventilation gap can be connected with the ventilation channel within the lamp holder for air circulation with ambient air. The ventilation channel can be connected with ambient air through the ventilation holes of the bulb-shaped shell. The bottom of the ventilation gap can further communicate with holes to the ambient air.

The lamp holder can have an outer contour having a 3-dimensional shape of a polyhedron, cylinder, frustum, or any suitable 3-D shapes. By using the 3-D shape of the lamp holder, the entire light emitting angle of LED sources configured thereon can be expanded as desired, e.g., to achieve lighting effects similar to an incandescent. In one embodiment, the lamp holder can be frustum-shaped having each sidewall mounted with a single substrate.

To further enhance the heat dissipation, inner cooling plate(s) can be longitudinally configured and distributed within the ventilation channel of the lamp holder. In one embodiment, a receiving ring can be fixed on the outer periphery of a lower portion of the driving power source casing. The receiving ring can be configured against a lower portion of the heat dissipation lamp cup. The receiving ring can support the heat dissipation lamp cup. A plurality of holes can be formed on the receiving ring along a circumferential direction. The holes can maintain an air circulation between the ambient air and the gap.

Along a circumferential direction on the outer wall of the driving power source casing, at least two (or any suitable number of) convex ribs can be configured along a length (e.g., longitudinally or vertically) of the driving power source casing to secure (or lock) a position of driving power source casing with respect to the inner wall of the heat dissipation lamp cup. The convex ribs can facilitate mounting of the driving power source casing. The convex ribs can be configured against the inner wall of the heat dissipation lamp cup. The convex ribs can be configured such that a fixed distance for the ventilation gap is maintained between the outer wall of the driving power source casing and the inner wall of the heat dissipation lamp cup. To facilitate mounting and fixing, the convex ribs may contain screw holes used to mechanically connect with the heat dissipation lamp cup, e.g., by screws.

A plurality of outer cooling plates can be longitudinally configured and circumferentially distributed along the outer periphery of the heat dissipation lamp cup. The bulb-shaped shell can have an upper portion including a circular opening clipped with an annular ring having a cover. The cover can include a plurality of ventilation holes.

As disclosed, the LED lighting device can be configured having an internal cooling passage and an external cooling passage. The internal cooling passage can be provided to include: the ventilation gap maintained between the outer wall of the driving power source casing and the inner wall of the heat dissipation lamp cup and the ventilation channel within the lamp holder configured on the heat dissipation lamp cup. The top and bottom of the internal cooling passage can be connected to the ambient air for air circulation to take away heat generated by the driving power source and LED light sources, to reduce environment temperature of the driving power source, and to extend the lifespan of the device. Temperature of the outside of the heat dissipation lamp cup can also be reduced to protect human hands from being burned when touching the lamp cup.

Figure 2:
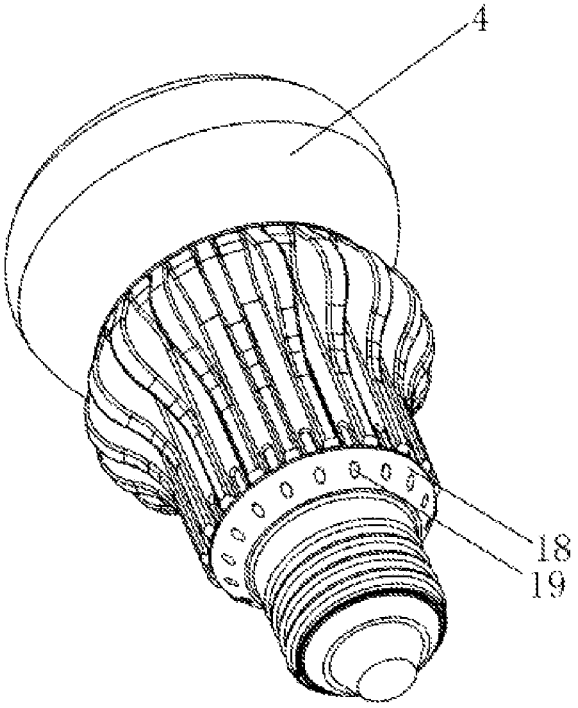
FIG. 2 is a schematic illustrating another perspective view of an exemplary LED lighting device consistent with various disclosed embodiments.
Figure 3:
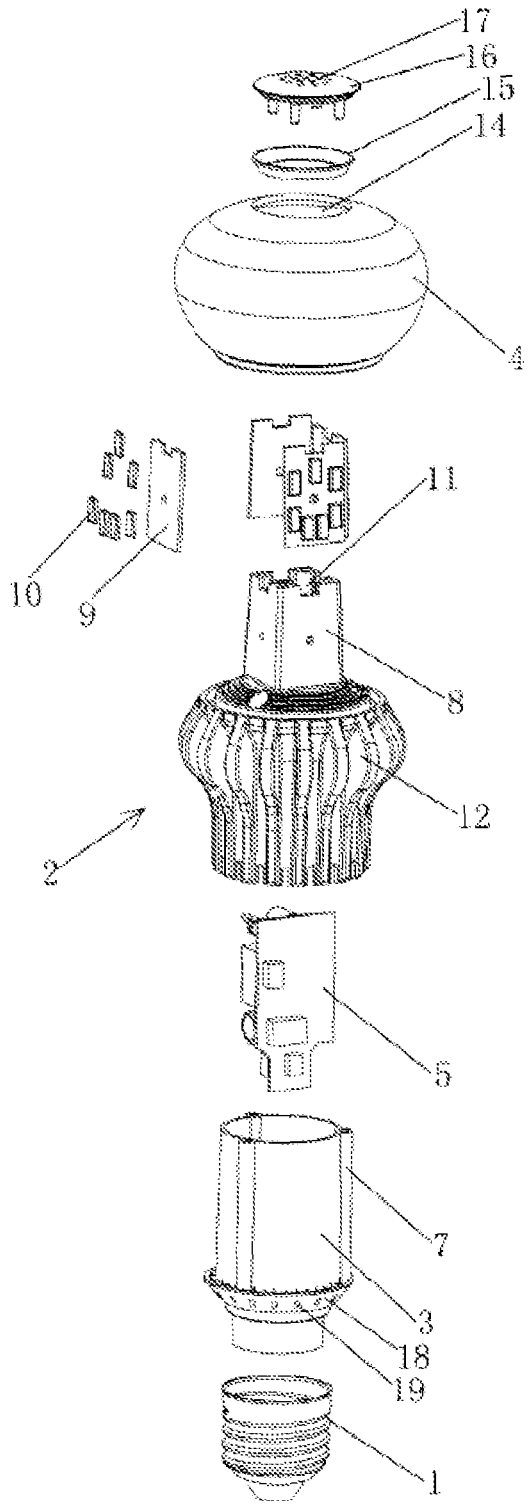
FIG. 3 is a schematic illustrating an exploded view of an exemplary LED lighting device consistent with various disclosed embodiments.
Figure 4:
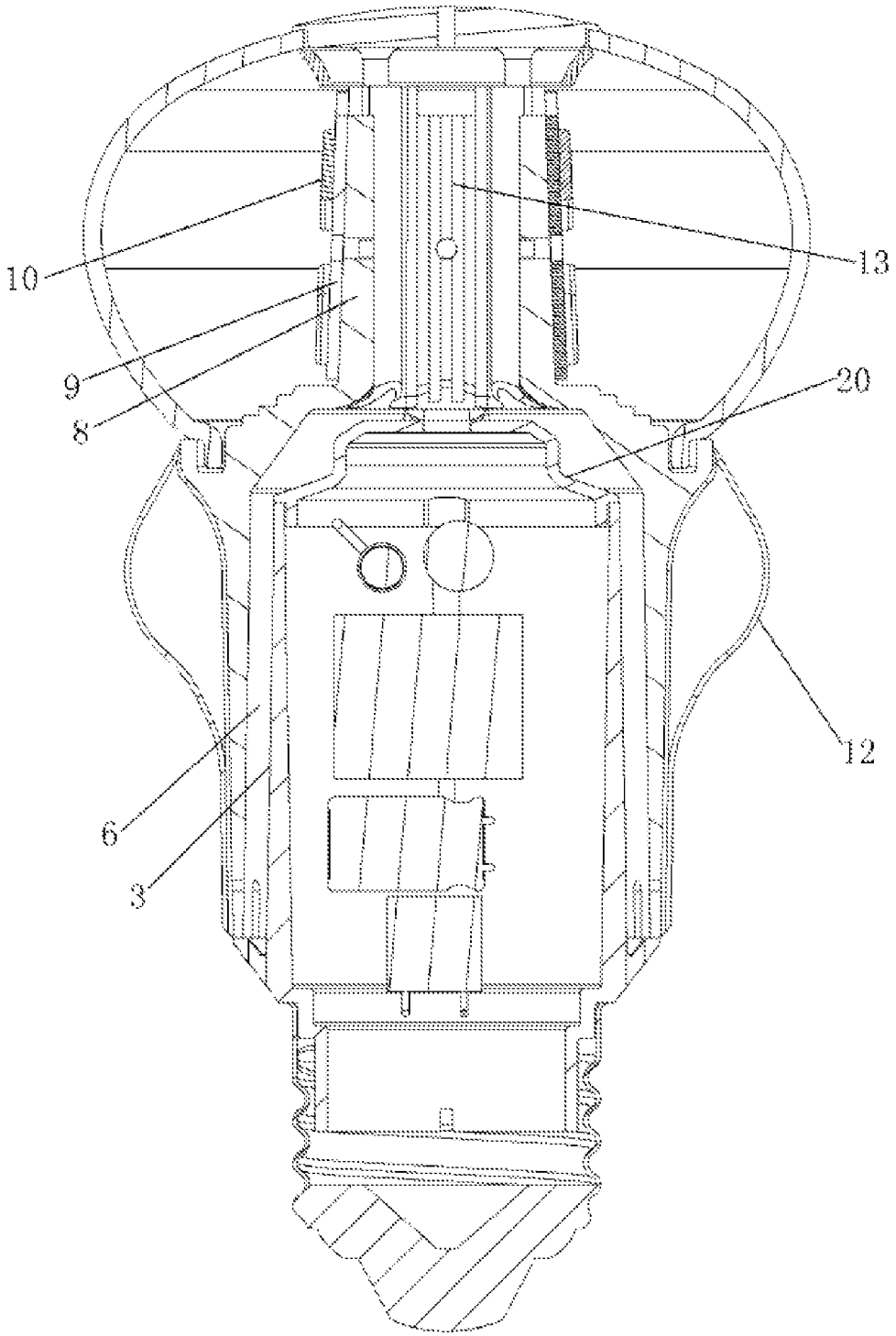
FIG. 4 is a schematic illustrating a sectional view AA of FIG. 1 consistent with various disclosed embodiments.
Figure 5:
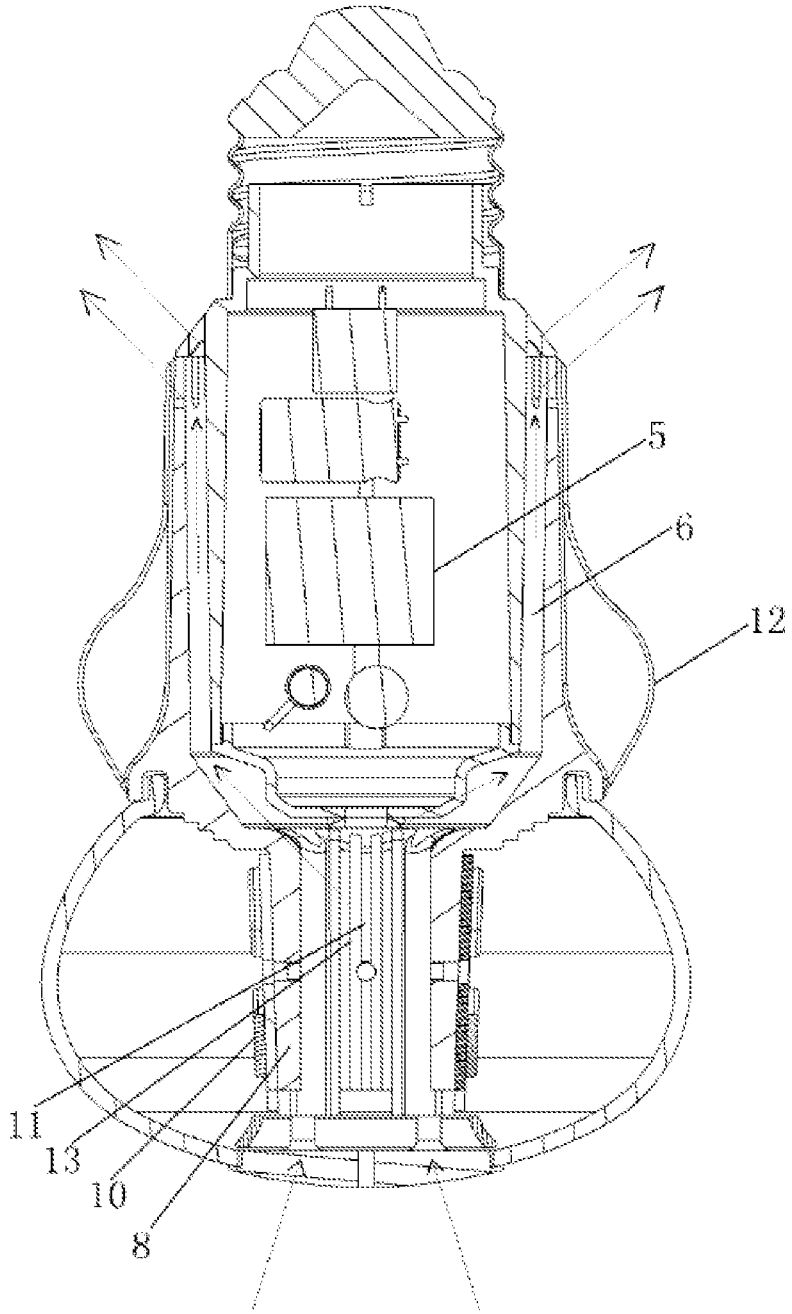
FIG. 5 is a schematic illustrating the cooling effect of an exemplary LED lighting device consistent with various disclosed embodiments.

FIGS. 1-4 depict an exemplary LED lighting device having a heat dissipation structure (which may also be referred to as a cooling structure). For example, FIGS. 1-2 illustrate perspective views of an exemplary LED lighting device; FIG. 3 illustrates an exploded view of the exemplary LED lighting device; FIG. 4 illustrates a sectional view AA of FIG. 1; and FIG. 5 illustrates cooling effect of an exemplary LED lighting device.

As shown in FIGS. 1-3, the exemplary LED lighting device can include a lamp head 1, a heat dissipation lamp cup 2, a driving power source casing 3, a bulb-shaped shell 4, a driving power supply 5, convex ribs 7, a lamp holder 8, a substrate 9, LED light sources 10, outer cooling plates 12, inner cooling plates 13, an annular ring 15, a cover 16, and/or a receiving ring 18.

The lamp head 1 can be used to electrically and/or mechanically connect the LED lighting device (e.g., at one end of the lamp head 1) with other suitable components (e.g., external components or circuits) for use of the LED lighting device. The lamp head 1 can also function as, e.g., a lamp holder at the bottom of the LED lighting device.

The heat dissipation lamp cup 2 can be referred to as a cooling lamp cup or a heat sink. The heat dissipation lamp cup 2 can be configured having a hollow structure over the lamp head 1. The heat dissipation lamp cup 2 can be configured in a form of a cylinder having various cross-sectional shapes including, for example, a circle, a rectangle, a square, and/or a triangle. For example, the heat dissipation lamp cup 2 can be a cylinder having one or more cross-sectional shapes for the heat dissipation lamp cup 2, which can have an outer shape, such as a cup, a lantern, or any suitable hollow structures.

The heat dissipation lamp cup 2 can include a plurality of outer cooling plates 12 longitudinally configured and circumferentially distributed along the outer periphery of the heat dissipation lamp cup 2. The plurality of outer cooling plates 12 can have a shape comply with the outer shape of the heat dissipation lamp cup 2. Each outer cooling plate 12 can have a varied width along a longitudinally direction of the heat dissipation lamp cup 2. In one embodiment, the plurality of cooling plates 12 can be configured accordion-like.

The heat dissipation lamp cup 2 can be configured socket jointing with the driving power source casing 3, while forming a ventilation gap 6 between the driving power source casing 3 and inner wall of the heat dissipation lamp cup 2 for ventilation, as shown in FIG. 4. The driving power source casing 3 can have an outer diameter less than an inner diameter of the heat dissipation lamp cup 2.

Along a circumferential direction on the outer wall of the driving power source casing 3, three (or any suitable number) of convex ribs 7 are configured along a length (e.g., vertically) of the driving power source casing 3 to secure (or lock) a position of driving power source casing 3 with respect to the inner wall of the heat dissipation lamp cup 2. For example, the convex ribs 7 can be configured against the inner wall of the heat dissipation lamp cup 2. The convex ribs 7 can be configured such that a fixed distance is maintained between the outer wall of the driving power source casing 3 and the inner wall of the heat dissipation lamp cup 2. In the meanwhile, in order to facilitate mounting and fixing, the top of the convex ribs 7 can contain screw holes. The convex ribs 7 can be mechanically connected with the heat dissipation lamp cup 2, e.g., by screws. As such, the driving power source casing 3 and the heat dissipation lamp cup 2 can be mechanically connected together with one another.

The driving power supply 5 can be mounted within the driving power source casing 3. The driving power source casing 3 can include an upper cover 20 of the driving power source casing 3.

To increase the angle for light emitting, the lamp holder 8 can be configured to protrude from a top surface of the heat dissipation lamp cup 2. The lamp holder 8 can have a diameter (or a width) less than a diameter (or a width) of the heat dissipation lamp cup 2. The lamp holder 8 can have at least two sidewalls. A substrate can be configured on each sidewall of the lamp holder 8. LED light sources can then be fixed on each substrate.

In one embodiment, the lamp holder 8 can have an outer contour that is frustum shaped. An aluminum substrate 9 can be fixed on each sidewall of the lamp holder 8. A plurality of LED light sources 10 can be mounted or otherwise fixed on the substrate 9. The lamp holder 8, the heat dissipation lamp cup 2, the driving power source casing 3, and/or the bulb-shaped shell 4 can be co-axially configured.

The substrate 9 and the lamp holder 8 can be mechanically connected by screw(s). In one embodiment, the substrate 9 and/or each sidewall of the lamp holder 8 can be configured having a longitude angle made with the axial center of the heat dissipation lamp cup 2 such that all of the exemplary LED light sources 10 configured over the outer sidewall of the lamp holder 8 can provide a total light emitting angle of about 300 degrees or greater, compared with traditional LED lights only having 180-degree coverage of light emitting. The disclosed LED lighting device can meet Energy Star standards.

The lamp holder 8 can include a hollow structure. The lamp holder 8 can be configured to have a ventilation channel 11 longitudinally through the entire lamp holder, e.g., between a top surface and a bottom surface of the lamp holder 8. In various embodiments, inner cooling plates 13 can be longitudinally configured and distributed within the ventilation channel 11 of the lamp holder 8.

The bulb-shaped shell 4 can have a bottom portion configured on top of the heat dissipation lamp cup 2. The lamp holder 8, the substrate 9, and the ventilation channel 11 can be within the bulb-shaped shell 4. The bulb-shaped shell 4 can have an upper portion including a circular opening 14. An annular ring 15 can be clipped or otherwise configured to fit the circular opening 14. A cover 16 can be included within the annular ring 15. The cover 16 can include a plurality of ventilation holes 17 such that an upper portion of the ventilation channel 11 can be connected with ambient air through the ventilation holes 17, as shown in FIG. 3.

A receiving ring 18 can be fixed on the outer periphery of a lower portion of the driving power source casing 3. The receiving ring 18 can be configured against a lower portion of the heat dissipation lamp cup 2. A plurality of holes 19 can be formed on the receiving ring 18 along a circumferential direction. The holes 19 can maintain an air circulation between the ambient air and the ventilation gap 6.

The driving power source casing 3 can be made of thermally conductive plastic materials to effectively distribute the heat. The upper portion of the ventilation gap 6 and the lower portion of the ventilation channel 11 can maintain air circulation to form an air flow path for interior cooling of the LED lighting device.

As shown in FIG. 5, when the LED lighting device is in operation, the driving power supply 5 generates heat, which is distributed inside the ventilation gap 6. A portion of the heat generated by the LED light sources 10 can be dissipated through the inner cooling plates 13 within the lamp holder 8 to the ventilation channel 11 of an internal cooling passage. Another portion of the heat generated by the LED light sources 10 can be dissipated through the lamp holder 8 to the plurality of outer cooling plates 12 of the heat dissipation lamp cup 2.

As indicated by the arrows in FIG. 5, air can flow into an internal cooling passage of the LED lighting device from the ventilation holes 17, through the ventilation channel 11, to the ventilation gap 6 and then discharged from the bottom of the ventilation gap 6, so as to take away heat within the ventilation channel 11 and the ventilation gap 6. Heat can be dissipated via an external cooling passage from the outer cooling plates 12 of the heat dissipation lamp cup 2 by natural convection of air. The arrows in FIG. 5 can indicate air flow in the LED lighting device.

As disclosed, the exemplary LED lighting device can combine an internal cooling process and an external cooling process for heat dissipation. This can reduce environmental temperature for the power supply to work, to ensure use life of the power supply. In addition, heat generated by the LED lighting devices can be significantly scattered to effectively reduce the temperature of outer surface of the heat dissipation lamp cup 2 to protect human hands from being burned when touching the outer surface of the heat dissipation lamp cup 2. Further, the disclosed LED lighting device can be built having a fan configured, e.g., inside the ventilation channel 11 and the ventilation gap 6, to further enhance the cooling effect.

In various embodiments, the disclosed LED lighting device can include an anti-breakdown LED light source. In this case, a printed circuit board (PCB) board over the cooling substrate can be configured on the substrate on the sidewall of the heat-dissipation lamp cup 2. The LED light sources can include a positive electrode and a negative electrode that are provided on the PCB board and are connected to the driving power supply. Screws can be used to attach the PCB board to the substrate on the heat dissipation lamp cup 2. In one example, a screw head can be electrically connected to one of the positive electrode and the negative electrode. A screw body can be electrically connected to the heat-dissipation lamp cup 2, such that the screw(s) provide a bypass discharge path between the LED light sources and the heat-dissipation lamp cup 2 to release leakage current and to protect the LED light sources.

A conductive circuit may be printed on the PCB board to electrically connect the screw head with the one of the positive electrode and the negative electrode. The heat-dissipation lamp cup 2 can be mechanically attached to a plastic/rubber base by a fixing element at the bottom of the heat dissipation lamp cup 2. The PCB board includes a layered structure having a copper foil circuit layer disposed on a dielectric layer that is disposed on a thermally conductive layer. The LED light source(s) can be soldered on the copper foil circuit layer of the PCB board. The driving power supply is connected by wiring to the positive electrode and the negative electrode. The PCB board can be entirely attached to the substrate by about four screws.

The embodiments disclosed herein are exemplary only. Other applications, advantages, alternations, modifications, or equivalents to the disclosed embodiments are obvious to those skilled in the art and are intended to be encompassed within the scope of the present disclosure.

INDUSTRIAL APPLICABILITY AND ADVANTAGEOUS EFFECTS

Without limiting the scope of any claim and/or the specification, examples of industrial applicability and certain advantageous effects of the disclosed embodiments are listed for illustrative purposes. Various alternations, modifications, or equivalents to the technical solutions of the disclosed embodiments can be obvious to those skilled in the art and can be included in this disclosure.

In some embodiments consistent with the present disclosure, an LED lighting device may use certain components for heat dissipation as well as leakage protection. For example, in an LED lighting device, air can flow into an internal cooling passage of the LED lighting device from the ventilation holes 17, through the ventilation channel 11, to the ventilation gap 6 and then discharged from the bottom of the ventilation gap 6, so as to take away heat within the ventilation channel 11 and the ventilation gap 6. Heat can be dissipated via an external cooling passage from the outer cooling plates 12 of the heat dissipation lamp cup 2 by natural convection of air.

Further, in the LED lighting device, in addition to dissipating heat, the heat dissipation lamp cup 2 may be a part of a circuit to protect LED light sources. For example, a printed circuit board (PCB) board over the cooling substrate can be configured on the substrate on the sidewall of the heat-dissipation lamp cup 2. The LED light sources can include a positive electrode and a negative electrode that are provided on the PCB board and are connected to the driving power supply. Screws can be used to attach the PCB board to the substrate on the heat dissipation lamp cup 2. In one example, a screw head can be electrically connected to one of the positive electrode and the negative electrode. A screw body can be electrically connected to the heat-dissipation lamp cup 2, such that the screw(s) provide a bypass discharge path between the LED light sources and the heat-dissipation lamp cup 2 to release leakage current and to protect the LED light sources.

Embodiments consistent with the present disclosure may combine the designs for heat dissipation and leakage protection of an LED light device to extend the lifespan of the device.

What is claimed is:

1. An LED lighting device comprising:

a heat dissipation lamp cup including a hollow structure;

a driving power supply casing socket joint within the heat dissipation lamp cup to form a ventilation gap between the driving power source casing and an inner wall of the heat dissipation lamp cup;

a lamp holder configured on top of the heat dissipation lamp cup, wherein the lamp holder includes one or more sidewalls forming a ventilation channel passing through the lamp holder, and wherein the ventilation channel is connected to the ventilation gap for air circulation;

a substrate configured on an outer surface of each of the one or more sidewalls of the lamp holder; and a plurality of LED light sources mounted on the substrate.

2. The device according to claim 1, further including a bulb-shaped shell configured on the heat dissipation lamp cup to enclose the lamp holder, wherein the plurality of LED light sources are within the bulb-shaped shell.

3. The device according to claim 2, wherein the bulb-shaped shell includes a cover configured with a plurality of ventilation holes for air circulation.

4. The device according to claim 1, further including a plurality of outer cooling plates longitudinally configured and circumferentially distributed along an outer periphery of the heat dissipation lamp cup to facilitate heat dissipation.

5. The device according to claim 1, wherein the lamp holder includes an outer contour providing a 3-dimensional shape including a polyhedron, a cylinder, or a frustum.

6. The device according to claim 1, wherein the lamp holder is configured such that an entire light emitting angle of the plurality of LED sources is about 300 degree or greater.

7. The device according to claim 1, further including a plurality of inner cooling plates longitudinally configured and distributed within the ventilation channel of the lamp holder.

8. The device according to claim 1, further including a receiving ring configured on an outer periphery of a lower portion of the driving power source casing and configured against a lower portion of the heat dissipation lamp cup.

9. The device according to claim 8, wherein the receiving ring supports the heat dissipation lamp cup and includes a plurality of holes connected to the ventilation gap for the air circulation with ambient air.

10. The device according to claim 1, further including at least two convex ribs longitudinally configured along a length of the driving power source casing to lock a position of the driving power source casing with respect to the inner wall of the heat dissipation lamp cup.

11. The device according to claim 10, wherein the at least two convex ribs are configured such that a fixed distance for the ventilation gap is maintained between an outer wall of the driving power source casing and the inner wall of the heat dissipation lamp cup.

12. A method for making an LED lighting device, comprising:

providing a heat dissipation lamp cup including a hollow structure;

socket-configuring a driving power supply casing within the heat dissipation lamp cup to provide a ventilation gap between the driving power source casing and an inner wall of the heat dissipation lamp cup;

configuring a lamp holder on top of the heat dissipation lamp cup, wherein the lamp holder includes one or more sidewalls forming a ventilation channel passing through the lamp holder and wherein the ventilation channel is connected to the ventilation gap for air circulation;

configuring a substrate on an outer surface of each of the one or more sidewalls of the lamp holder; and configuring a plurality of LED light sources on the substrate.

13. The method according to claim 12, further including a bulb-shaped shell configured on the heat dissipation lamp cup to enclose the lamp holder, wherein the plurality of LED light sources are within the bulb-shaped shell.

14. The method according to claim 13, wherein the bulb-shaped shell includes a cover configured with a plurality of ventilation holes for the air circulation.

15. The method according to claim 12, further including a plurality of outer cooling plates longitudinally configured and circumferentially distributed along an outer periphery of the heat dissipation lamp cup to facilitate heat dissipation.

16. The method according to claim 12, wherein the lamp holder has an outer contour provide a 3-dimensional shape including a polyhedron, a cylinder, or a frustum.

17. The method according to claim 12, wherein the lamp holder is configured such that an entire light emitting angle of the plurality of LED sources is about 300 degree or greater.

18. The method according to claim 12, further including a plurality of inner cooling plates longitudinally configured and distributed within the ventilation channel of the lamp holder.

19. The method according to claim 12, further including a receiving ring configured on an outer periphery of a lower portion of the driving power source casing and configured against a lower portion of the heat dissipation lamp cup, wherein the receiving ring supports the heat dissipation lamp cup and includes a plurality of holes connected to the ventilation gap for air circulation with ambient air.

20. The method according to claim 12, further including at least two convex ribs longitudinally configured along a length of the driving power source casing to lock a position of the driving power source casing with respect to an inner wall of the heat dissipation lamp cup.

* * * * *